US006129603A

United States Patent [19]

Sun et al.

[11] Patent Number: 6,129,603

[45] Date of Patent: Oct. 10, 2000

[54] LOW TEMPERATURE GLASS FRIT SEALING FOR THIN COMPUTER DISPLAYS

[75] Inventors: Jennifer Y. Sun, Myrtle Beach, S.C.; Yutao Ma, Sunnyvale, Calif.

[73] Assignee: Candescent Technologies Corporation, San Jose, Calif.

[21] Appl. No.: 08/881,882

[22] Filed: Jun. 24, 1997

[51] Int. Cl.[7] ..... H01J 9/26

[52] U.S. Cl. ..... 445/25; 313/495

[58] Field of Search ..... 445/24, 25; 313/495, 313/497

[56] References Cited

U.S. PATENT DOCUMENTS 4,058,387 11/1977 Nofziger ..... 445/45 X
5,424,605 6/1995 Lovoi ..... 313/422
5,688,708 11/1997 Kato et al. ..... 445/25
5,697,825 12/1997 Dynka et al. ..... 445/25

*Primary Examiner*—Kenneth J. Ramsey
*Attorney, Agent, or Firm*—Wagner, Murabito & Hao LLP

[57] ABSTRACT

A flat panel display and a method for forming a flat panel display. In one embodiment, the flat panel display includes a sealed interior region formed by heating a low temperature glass frit in a vacuum. The low temperature glass frit is placed between a faceplate and a backplate. The low temperature glass frit is heated such that it melts, forming a sealed interior region between the faceplate and the backplate which is hermetically sealed. The low temperature glass frit allows for melting of the glass frit at a temperature lower than that of prior art processes. The resulting sealed interior region is in a vacuum. Therefore, evacuation tubes are not required and process steps associated with evacuation through an evacuation tube are eliminated.

14 Claims, 4 Drawing Sheets

LOW TEMPERATURE GLASS FRIT SEALING FOR THIN COMPUTER DISPLAYS

TECHNICAL FIELD

The present claimed invention relates to the field of flat panel displays. More specifically, the present claimed invention relates to a flat panel display and methods for forming a flat panel display having a seal formed using a low temperature glass frit.

BACKGROUND ART

A Cathode Ray Tube (CRT) display generally provides the best brightness, highest contrast, best color quality and largest viewing angle of prior art displays. CRT displays typically use a layer of phosphor which is deposited on a thin glass faceplate. These CRTs generate a picture by using one to three electron beams which generate high energy electrons that are scanned across the phosphor in a raster pattern. The phosphor converts the electron energy into visible light so as to form the desired picture. However, prior art CRT displays are large and bulky due to the large vacuum bottles that enclose the cathode and extend from the cathode to the faceplate of the display. Therefore, typically, other types of display technologies such as active matrix liquid crystal display, plasma display and electroluminiscent display technologies have been used in the past to form thin displays.

Recently, a thin flat panel display (FPD) has been developed which uses the same process for generating pictures as is used in CRT devices. These flat panel displays use a backplate including a matrix structure of rows and columns of electrodes. One such flat panel display is described in U.S. Pat. No. 5,541,473 which is incorporated herein by reference. Typically, the backplate is formed by depositing a cathode structure (electron emitting) on a glass plate. The cathode structure includes emitters that generate high energy electrons. The backplate typically has an active area within which the cathode structure is deposited. Typically, the active area does not cover the entire surface of the glass plate, leaving a thin strip around the edges of the glass plate. Traces extend through the thin strip to allow for connectivity to the active area. These traces are typically covered by a dielectric film as they extend across the thin strip so as to prevent shorting.

Prior art flat panel displays include a thin glass faceplate having one or more layers of phosphor deposited over the interior surface thereof. The faceplate is typically separated from the backplate by about 1 millimeter. The faceplate includes an active area within which the layer (or layers) of phosphor is deposited and a thin strip that does not contain phosphor. The thin strip extends from the active area to the edges of the glass plate. The faceplate is attached to the backplate using a glass sealing structure. This sealing structure is formed by melting a glass frit in a high temperature heating step. This forms an enclosure which is evacuated so as to produce a vacuum between the active area of the backplate and the active area of the faceplate. Individual regions of the cathode are selectively activated to generate high energy electrons which strike the phosphor so as to generate a display within the active area of the faceplate. These flat panel displays have all of the advantages of conventional CRTs but are much thinner.

In another prior art flat panel display design, a ceramic frame is placed between the glass faceplate and the backplate. Glass frit is placed on each side of the ceramic frame and the flat panel display assembly is heated. The glass frit is heated so as to form a seal between the ceramic frame and the backplate and a corresponding seal between the ceramic frame and the faceplate.

In prior art fabrication processes, a hollow evacuation tube is placed such that it extends across the thin strip of the backplate. Typically a glass or copper tube is used as the evacuation tube (also referred to as a pump port). A thin layer of glass frit is then deposited around the backplate such that the glass frit surrounds the active area of the backplate. The enclosure is only interrupted by the evacuation tube which extends across the layer of glass frit.

The faceplate is then placed over the glass frit on the backplate such that the active area of the faceplate is aligned with the active area of the backplate. The resulting flat panel display assembly is then placed in an oven where a high temperature process step is performed so as to melt the frit. The glass frit forms a seal between the faceplate and the backplate as it melts, forming an enclosure into which the evacuation tube extends. Typically, a temperature of at least 400 degrees centigrade is required to melt the glass frit.

The flat panel display assembly is then removed from the oven and a vacuum hose is attached to the evacuation tube. Any gas within the enclosure is then removed through the evacuation tube. The evacuation tube is then sealed off and the vacuum hose is removed. The resulting display assembly has a sealed enclosure which has a vacuum formed therein.

The bonding process is time consuming and expensive due to the numerous fabrication steps. In addition, the high temperatures required during the sealing process damages the emitters so as to degrade the cathode. Also, the setup and down cycle during the sealing process induces stress to the faceplate and the backplate. Moreover, the high temperatures cause the structures on the surfaces of the display assembly to outgass (Typically, polymer present on the surfaces of the faceplate and the backplate is outgassed). This outgassing results in contaminate species absorbed by the active area of the backplate or faceplate. The outgassed contamination of degrade or oxidize the emitter surface causing electron emissions to be temporally unstable and in general, reduced. In addition, ions formed through the collision of electrons with gas molecules can be accelerated into the emitter tips and may therefore degrade their emission. Plasma formed in the same manner can short emitter tips to the overlying gate and can cause arcing at high field regions in the display. Thus, outgassing interferes with the operation of the cathode, resulting in reduced image quality.

Outgassing is reduced in prior art flat panel display by the use of materials that have a low outgassing rate and that have a low vapor pressure. Thus, only metals, glasses, ceramics, and select specially processed polymers are typically used within flat panel displays. These materials are typically processed by baking (at several hundred degrees centigrade) and electronically or otherwise scrubbing in order to remove adhered molecules. However, only some of the outgassing may be eliminated by such processes. Thus, the materials, and in particular, the polymer surfaces outgass during the high temperature steps of prior art processes, producing harmful $O_2$, $H_2O$, CO, and $CO_2$. Typically, a getter is used to minimize damage resulting from outgassing. The getter absorbs some of the chemicals released by outgassing. However, getter only absorbs certain outgassing moleculars, allowing the remainder of the damaging moleculars to fall onto the active surfaces of the flat panel display.

Alternate prior art heating methods for forming a seal between the faceplate and the backplate include the use of lasers which are focused on the glass frit. Typically, such methods heat the glass frit to temperatures of more than 600 degrees centigrade. However, since the heat is localized, the damage such as oxidation to the active areas is reduced. Damage resulting from oxidation is typically reduced by performing the heating process in an inert gas environment such as nitrogen. However, in order to prevent the glass of the faceplate and the backplate form cracking or breaking from the sudden temperature increase and a large temperature difference between the components, the display assembly must be heated in an oven to the glass transition temperature which is typically 300 to 325 degrees centigrade. This high oven temperature causes oxidation which results in cathode degradation. Moreover, the 325 degree temperature stresses the surfaces of the faceplate and the backplate and causes a significant amount of outgassing.

In an attempt to solve the inherent in prior art sealing process, prior art display assemblies employing pump ports and/or evacuation tubes, have attempted to heat the display assembly in a vacuum. However, glass frit is not stable at high temperatures in a vacuum, resulting in disassociation of the glass structure ($2PbO \rightarrow 2Pb+O_2$). The resulting lead and oxygen causes oxidation and contamination. Moreover, the high temperature of the sealing process results in stress to the faceplate and to the backplate and cathodic degradation and outgassing. Though the use of inert gasses such as nitrogen eliminates the problems associated with oxidation, these prior art processes still damage the active surfaces due to stress and outgassing.

With an evacuation scheme which includes an evacuation tube, the thickness of the display assembly is increased by the length of the evacuation tube. This limits the minimum thickness of the display assembly.

Flat panel display fabrication processes are expensive and the manufacturing process is time consuming due in large part to the number of complex steps required in the bonding process. Moreover, prior art bonding processes are performed at high temperatures, resulting in outgassing and heat generated defects. This decreases yield and increases overall manufacturing cost. In addition, the numerous process steps take up a long process time so as to cause low throughput rates.

Thus, a need exists for a flat panel display and a method for bonding a flat panel display which is relatively inexpensive and easy to manufacture. A further need exists for a flat panel display and a method for forming a flat panel display which does not damage the active areas during the bonding process. In particular, a need exists for a flat panel display and a method for forming a flat panel display which minimizes outgassing and thermal stress. A further need exists for a flat panel display and a method for forming a flat panel display which minimizes fab process time and which reduces manufacturing cost. Moreover, a flat panel display and a method for forming a flat panel display is needed that will increase yield and throughput of manufacturing. The present invention meets the above needs.

DISCLOSURE OF THE INVENTION

The present invention provides a flat panel display which is less complex than prior art flat panel displays and which is easier and less expensive to manufacture than prior art flat panel displays The fabrication of the flat panel display of the present invention requires less process steps than prior art flat panel display manufacturing processes, thereby increasing yield and throughput rates. The present invention achieves the above accomplishments with a flat panel display and a method of forming a flat panel display which allows for forming a vacuum within the flat panel display prior to sealing the flat panel display at a low temperature. The low temperature sealing process reduces outgassing. In addition, the present invention eliminates the need for an evacuation tube and eliminates some of the process steps of prior art processes.

In one embodiment of the present invention a backplate and a faceplate are formed and sealed together using a low temperature glass frit. The backplate is formed by forming a cathode on an active area of a glass plate. The faceplate is formed by depositing luminescent material within an active area formed on a glass plate. A low temperature glass frit is placed on the backplate such that the glass frit surrounds the active area of the backplate. The faceplate is then placed over the backplate such that the low temperature glass frit is sandwiched between the faceplate and the backplate. The backplate, the faceplate and the low temperature glass frit form a display assembly which is placed into an evacuated heating environment. The low temperature glass frit is heated so as to form a seal which bonds the faceplate to the backplate. Thus, a seal is formed around the periphery of the evacuated enclosure between the faceplate and the backplate.

In an alternate embodiment of the present invention, the low temperature glass frit may be deposited on both faceplate and the faceplate and or over the backplate. In yet another embodiment of the present invention, a ceramic frame may be placed between the faceplate and the backplate and low temperature glass frit may be dispensed between the ceramic frame, and the faceplate and between the ceramic frame and the backplate. Upon melting the low temperature glass frit in a vacuum, the faceplate and the backplate are bonded together to form an evacuated a enclosure.

The flat panel display of the present invention and the method of fabrication of a flat panel display of the present invention has reduced outgassing due to the use of a low temperature heating step to melt the low temperature glass frit. The reduced outgassing results in fewer defects and an increased yield. In addition, additional spacing limitations imposed by the use of an evacuation tube are eliminated since an evacuation tube is not required. Moreover, several process steps are eliminated, cycle time and manufacturing cost are reduced and throughput improved.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 2:
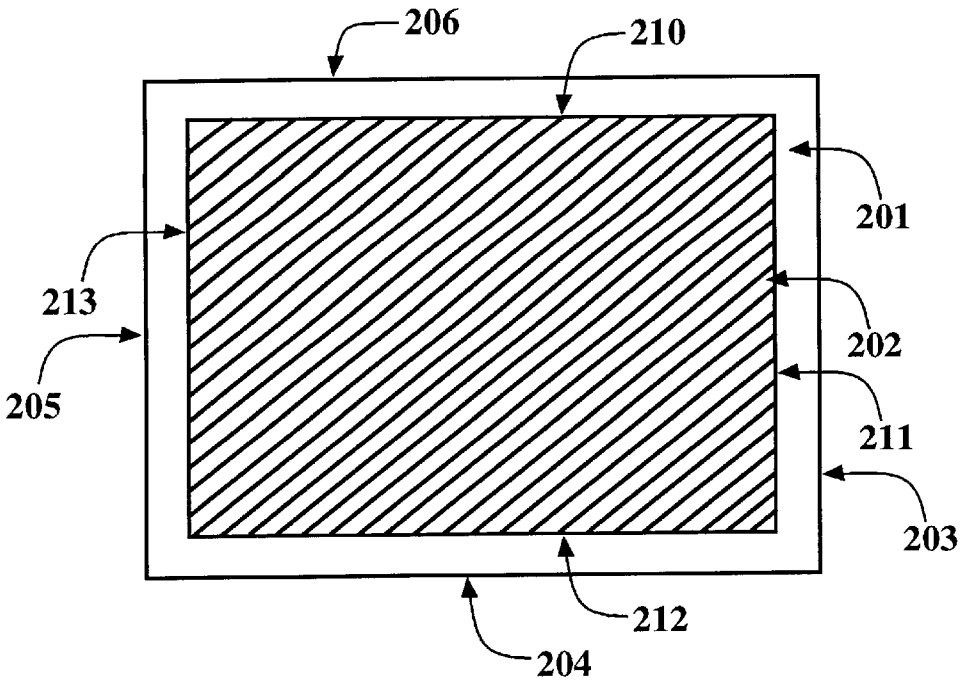
FIG. 2 is a top view illustrating a backplate in accordance with the present claimed invention.

In one embodiment of the present invention, a faceplate is formed by depositing phosphor onto a glass plate. The phosphor is deposited onto the glass plate so as to form an active area. FIG. 2 shows faceplate 201 which has side surfaces 203–206. The phosphor is deposited so as to form active area 202. Active area 202 does not cover the entire surface area of faceplate 201. Side surfaces 210–213 of active area 202 are separated from side surfaces 203–206 of faceplate 201 so as to allow for sealing of faceplate 201 to, for example, a backplate.

Figure 3:
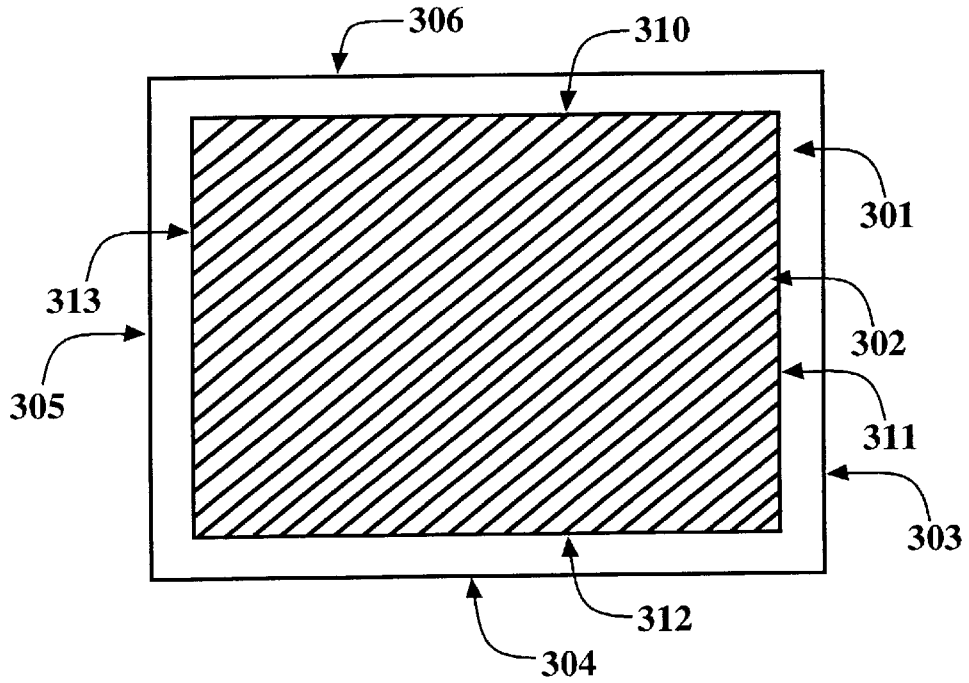
FIG. 3 is a top view illustrating a faceplate in accordance with the present claimed invention.

FIG. 3 shows backplate 301 to include active area 302 which includes side surfaces 310–313. In one embodiment of the present invention, backplate 301 is a glass plate onto which successive layers of material have been deposited so as to form cathodic structures within active area 302. These cathodic structures include emitters that emit high energy electrons. Spacers (not shown) may be attached to the backplate or the faceplate so as to give uniform spacing between the backplate and the faceplate. Structures such as electrical traces extend out of the active area. These structures are covered with a layer of dielectric such as an oxide layer so as to prevent shorting.

A getter is deposited or placed on either faceplate 201 of FIG. 2 or on backplate 301 of FIG. 3. The getter is typically an evaporated metal such as Barium or non-evaporated metallic stripes such as zirconium. The getter absorbs certain gasses emitted during the heating step so as to reduce damage caused by outgassing.

Figure 1:
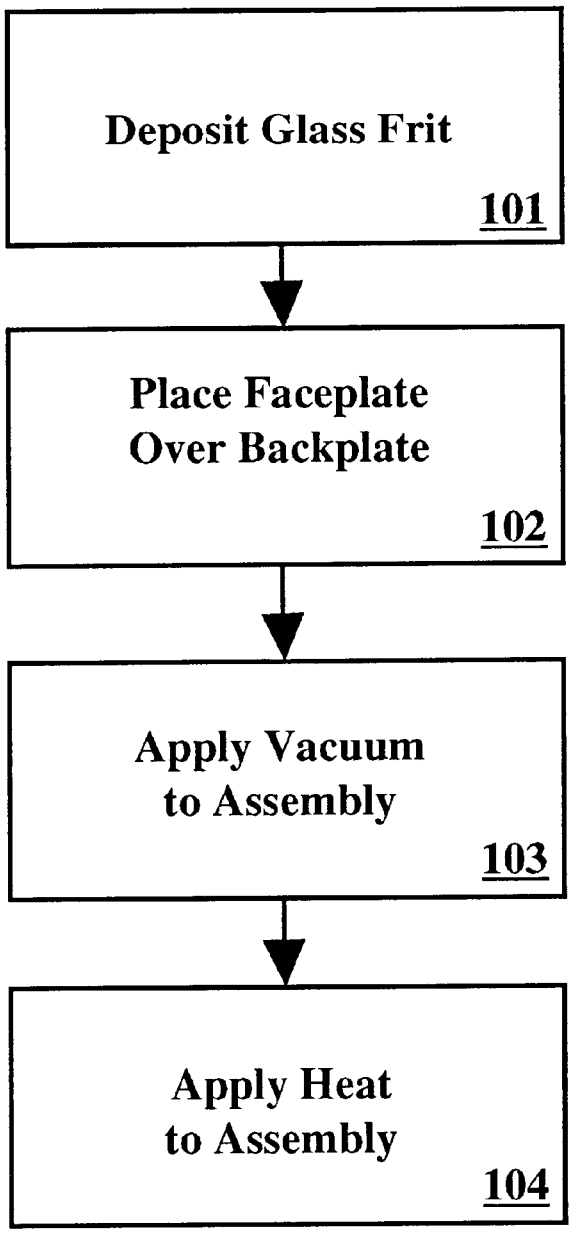
FIG. 1 is a diagram illustrating steps associated with the formation of a flat panel display in accordance with the present claimed invention.

In the present invention, low temperature glass frit is deposited over the backplate as shown by step 101 of FIG. 1. In one embodiment of the present invention the low temperature glass frit is deposited using a nozzle dispenser. Alternatively, the glass frit may be deposited using screen printing. Alternatively, the low temperature glass frit bar or frame is formed prior to deposition. Methods of forming low temperature glass frit bar or frame so as to obtain the desired shape and thickness include tape casting, molding, and extruding.

In one embodiment of the present invention, the low temperature glass frit is formed by mixing 2 percent to 4 percent by weight Q-Pac organic compound with NEG low temperature glass. Q-pac organic compound may be purchased from Pac Polymer of Delaware and NEG low temperature glass may be purchased from Nippon Electrical Glass of Ostu, Japan. The resulting low temperature glass frit has a glass transition temperature of 200–250 degrees centigrade.

Figure 4:
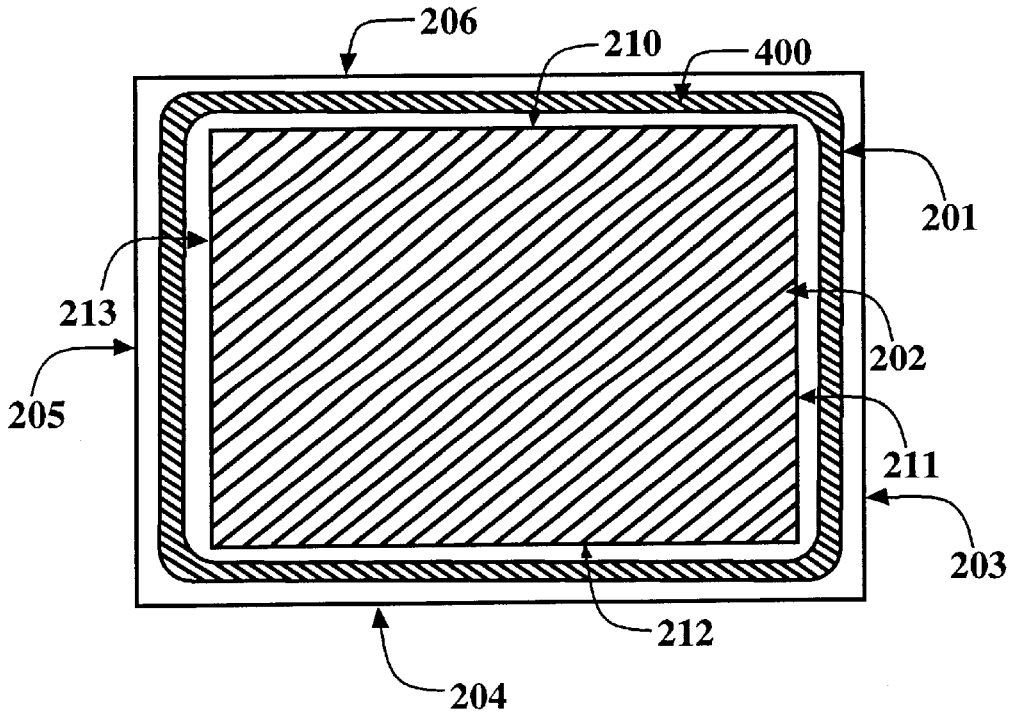
FIG. 4 is a top view illustrating a backplate after low temperature glass frit has been deposited thereover in accordance with the present claimed invention.

With reference to FIG. 4, low temperature glass frit 400 is deposited outside of active area 202 between side surfaces 210–213 and side surfaces 210–206. Traces which extend out from the active area (not shown) are covered by a dielectric layer to prevent shorting where they cross low temperature glass frit 400.

Figure 5:
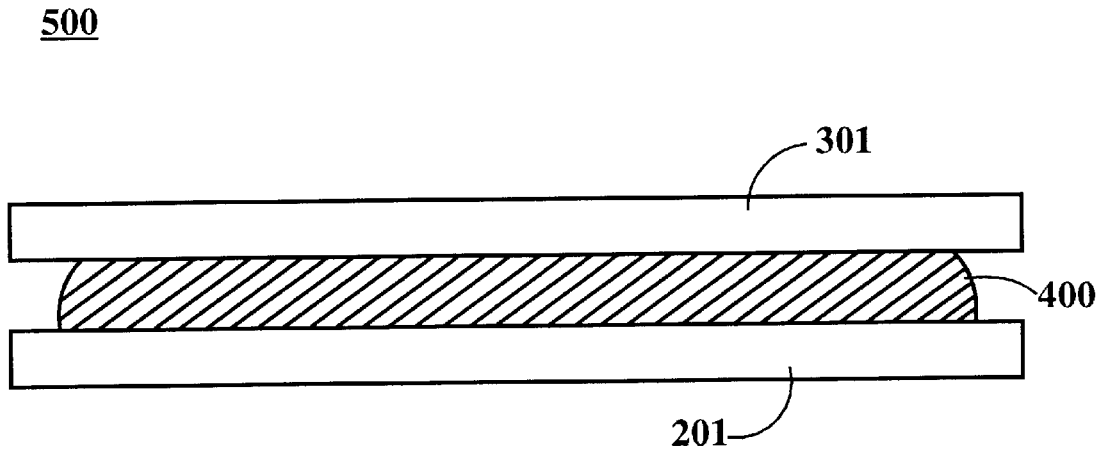
FIG. 5 is a side view of a flat panel display in accordance with the present claimed invention.

The faceplate is then placed over the backplate as shown by step 102 of FIG. 1. The placement of the faceplate over the backplate is performed so as to align active area 302 of FIG. 3 with active area 202 of FIG. 2. FIG. 5 shows faceplate 301 placed over backplate 201 such that low temperature glass frit 400 is disposed between backplate 201 and faceplate 301, forming display assembly 500.

As shown by step 103 of FIG. 1, display assembly 500 is placed in a vacuum. In one embodiment of the present invention, display assembly 500 is placed in an oven and the air is evacuated from the oven so as to produce a vacuum of $10_{-7}$ torr.

Heat is applied to the assembly as is shown by step 104 of FIG. 1. In one embodiment of the present invention heat is applied by engaging the oven. However, the heat can be provided by laser or IR source. Both set up with laser and IR lamp have been successfully tested. The heat melts the glass frit and bonds the faceplate to the backplate. In one embodiment of the present invention a temperature of 220 degrees centigrade is used. The heat is then disengaged. Once the glass frit has cooled sufficiently so as to produce an airtight seal, air is allowed to enter the oven, and the display assembly is removed from the oven. In one embodiment of the present invention, low temperature glass frit 400 has a thickness of approximately 50 mils prior to heating, giving a thickness of 30–40 mils after completion of the heating step. The melting of glass frit 400 forms an enclosure which is hermetically sealed.

Any temperature over the bias temperature of 200 degrees centigrade will melt the low temperature glass frit 400 of FIG. 4. Though it is desirable to keep the temperature as low as possible, the temperature must be high enough to efficiently melt low temperature glass frit 400 so as to minimize cycle time. The low bias temperature of low temperature glass frit 400 allows for melting at temperatures far below the prior art bias temperatures of 400 degrees centigrade. Thus, temperatures in the range of less than 300 degrees centigrade and above the bias temperature of 200 degrees centigrade allow for effective sealing of display assembly 500 of FIG. 5. As yet another advantage of the present invention, by melting glass frit 400 at temperatures below 300 degrees centigrade, the sealing process may be performed in a vacuum without disassociating the glass structure to produce unwanted lead and oxygen.

In one embodiment a melting temperature of 220 degrees centigrade is used. However, due to process variations, and materials requirements, the temperature may be varied within a range of plus or minus 10 degrees centigrade.

In an alternate embodiment of the present invention, a vacuum is applied to the assembly by placing the assembly into a vacuum chamber and evacuating the gas within the vacuum chamber. In this alternate embodiment, heat is applied to the assembly by a laser or lamps emitting IR which is directed at the low temperature glass frit. The display assembly is heated to a temperature equal to the bias temperature of the glass of the faceplate and the backplate. This temperature is typically 300 degrees centigrade.

Figure 6:
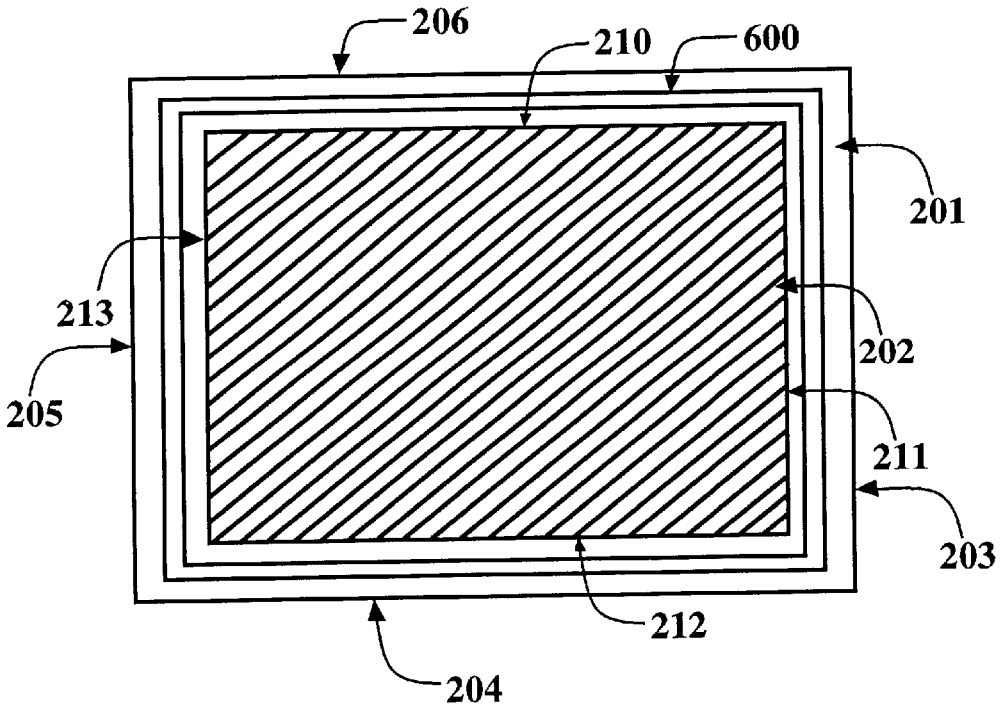
FIG. 6 is a top view illustrating a backplate after low temperature glass frit and a frame have been deposited thereover in accordance with a second embodiment of the present claimed invention.
Figure 7:
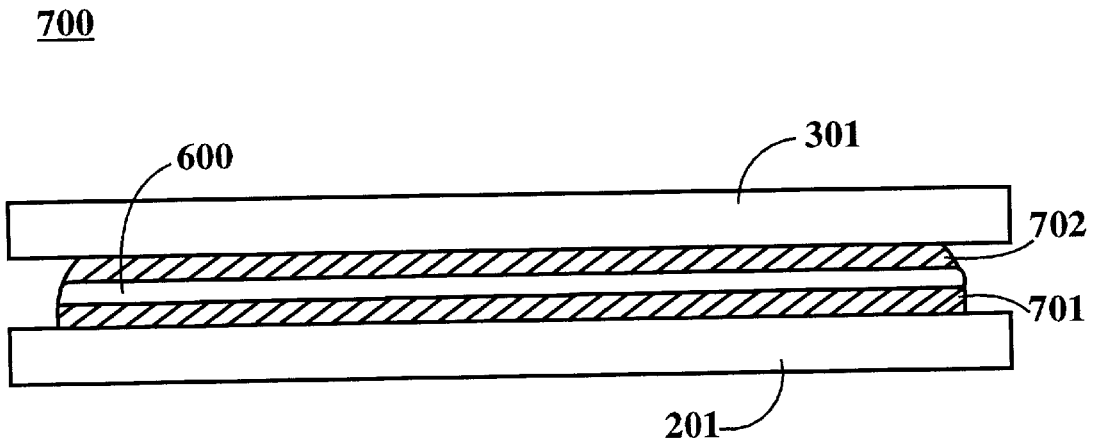
FIG. 7 is a side view of a flat panel display in accordance with a second embodiment of the present claimed invention.

Yet another embodiment of the present invention is shown in FIGS. 6–7 which includes frame 600. Spacer 600 is placed between side surfaces 210–213 of active area 202 and side surfaces 203–206 of backplate 201 so as to allow for a more precise control of the spacing between faceplate 301 and backplate 201. In one embodiment of the present invention, frame 600 is formed of ceramic material having a thickness of 35–40 mils. However a number of other materials with matching CTE could be used, such as glass, etc, as the frame materials.

Low temperature glass frit is placed above and below frame 600 and the faceplate is placed over the backplate so as to form display assembly 700 as shown in FIG. 7. Layer of low temperature glass frit 701 of FIG. 7 is placed below frame 600 such that it is dispensed between frame 600 and backplate 201. Similarly, layer of low temperature glass frit 702 is placed over frame 600 such that it is dispensed between frame 600 and faceplate 301. In one embodiment, low temperature glass frit layer 701 and low temperature glass frit layer 702 have a thickness of approximately 7–8 mils and frame 600 has a thickness of approximately 35–40 mils. Display assembly 700 is then placed in an oven and the air is evacuated from the oven. The oven is then engaged so as to apply heat to display assembly 700, melting the glass frit. The melting of the glass frit bonds faceplate 301 to frame 600 and bonds backplate 201 to frame 600. In so doing, faceplate 301 is bonded to backplate 201. As the glass frit cools, a hermetic seal is formed so as to produce an evacuated enclosure between faceplate 301 and backplate 201.

Alternatively, the present invention could be assembled starting with the faceplate. In such an embodiment of the present invention, the glass frit is placed over the faceplate and the backplate is placed over the faceplate so as to obtain a display assembly. In another embodiment where assembly starts with the faceplate, a first layer of glass frit is deposited over the faceplate and a frame is placed over the low temperature glass frit. A second layer of low temperature glass frit is then deposited on the other side of the frame and the backplate is placed over the faceplate.

The present invention eliminates the prior art process steps of placing an evacuation tube across the glass frit, attaching a vacuum hose to the evacuation tube, evacuating the display through the evacuation tube, sealing off the evacuation tube, and removing the vacuum hose. These steps take up valuable manufacturing processing time and decrease throughput. Thus, by eliminating these steps, the present invention increases throughput and decreases manufacturing cost.

The present invention eliminates the high temperature heating step of prior art manufacturing processes. The sealing temperature of the present invention (220 degrees centigrade) is significantly lower than the temperature of prior art sealing processes. This enables the sealing process to be performed in a vacuum without the decomposition of the glass frit into lead and oxygen. The lower temperature significantly lowers outgassing and reduces thermal degradation of the cathode. The reduction in outgassing and thermal stress reduces the number of defects and increases yield. In addition, the use of a lower temperature sealing process decreases cycle time and reduces stress on both the faceplate and the backplate.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A flat panel display having a backplate including an active area and a faceplate including an active area comprising:

a glass seal not having an evacuation tube extending therethrough, said glass seal disposed between said backplate and said faceplate and peripherally surrounding said active area of said faceplate and peripherally surrounding said active area of said backplate so as to attach said backplate to said faceplate, said glass seal and said backplate and said faceplate defining an evacuated enclosure, said evacuated enclosure enclosing said active area of said backplate and said active area of said faceplate, said glass seal formed by heating a low temperature glass frit in a vacuum, said low temperature glass frit having a bias temperature of less than 300 degrees centigrade.

2. The flat panel display of claim 1 wherein said low temperature glass frit has a bias temperature of about 200 degrees centigrade.

3. The flat panel display of claim 1 wherein said evacuated enclosure is at a pressure of about $10^{-7}$ torr.

4. The flat panel display of claim 1 wherein said glass seal further comprises:

a frame disposed between said faceplate and said backplate;

a first glass seal disposed between said frame and said faceplate; and a second glass seal disposed between said frame and said backplate, said first glass seal, said second glass seal, and said frame forming a hermetic seal so as to define an evacuated enclosure.

5. The flat panel display of claim 1 wherein said frame is comprised of ceramic.

6. A method for sealing a faceplate including an active area to a backplate having an active area comprising:

disposing low temperature glass frit between said backplate and said faceplate such that said low temperature glass frit is disposed around said active area of said backplate and around said active area of said faceplate; and heating said faceplate and said backplate and said low temperature glass frit, in a vacuum, to a temperature less than 300 degrees centigrade such that said low temperature glass frit melts, bonding said faceplate to said backplate so as to form a complete and evacuated enclosure between said faceplate and said backplate, said enclosure not having an evacuation tube extending therethrough.

7. The method for sealing a faceplate to a backplate of claim 6 wherein said step of heating said faceplate and said backplate and said low temperature glass frit further comprises:

heating said faceplate and said backplate and said low temperature glass frit to a temperature of about 220 degrees centigrade.

8. The method for sealing a faceplate to a backplate of claim 6 wherein said step of heating said faceplate and said backplate and said low temperature glass frit further comprises:

heating said faceplate and said backplate and said low temperature glass frit in a vacuum greater than 10–7 torr.

9. The method for sealing a faceplate to a backplate of claim 8 wherein said step of heating said faceplate and said backplate and said low temperature glass frit further comprises the step of:

directing a laser beam or focused IR source at said low temperature glass frit so as to selectively apply heat to said low temperature glass frit.

10. The method for sealing a faceplate to a backplate of claim 6 wherein said low temperature glass frit further comprises organic compound and low temperature glass.

11. The method for sealing a faceplate to a backplate of claim 6 further comprising the step of:

placing a frame between said backplate and said faceplate, said low temperature glass frit disposed between said frame and said backplate and between said frame and said faceplate such that, upon heating said faceplate and said backplate and said low temperature glass frit, said low temperature glass frit melts so as to form a hermetic seal enclosing said active area of said backplate and said active area of said faceplate.

12. The method for sealing a faceplate to a backplate of claim 11 wherein said frame is comprised of ceramic.

13. A method for forming a flat panel display having an evacuated enclosure comprising:

a.) forming a faceplate including an active area having luminescent generating material disposed thereon;

b.) forming a backplate including an active area which includes electron emitting structures;

c.) disposing low temperature glass frit on said backplate such that said low temperature glass frit is disposed around said active area of said backplate;

d.) placing said faceplate over said backplate such that said active area of said faceplate is aligned with said active area of said backplate;

e.) placing said faceplate and said backplate and said glass frit in an evacuated heating environment; and f.) heating said low temperature glass frit to a temperature sufficient to melt said low temperature glass frit, said temperature not more than approximately two hundred and twenty degrees, such that said low temperature glass frit bonds said faceplate to said backplate so as to form a complete and evacuated enclosure between said faceplate and said backplate, said enclosure not having an evacuation tube extending therethrough.

14. The method for forming a flat panel display of claim 13 wherein step c.) comprises:

placing a ceramic frame having a top surface, a bottom surface, and an open interior over said low temperature glass frit, and such that said bottom surface of said ceramic frame is disposed peripherally surrounding said low temperature glass frit such that said ceramic frame is disposed around said active area of said backplate; and placing low temperature glass frit over said top surface of said ceramic frame.

* * * * *